United States Patent [19]

Abba et al.

[11] Patent Number: 4,775,582

[45] Date of Patent: Oct. 4, 1988

[54] UNIFORMLY MOIST WIPES

[75] Inventors: William A. Abba, Neenah; James Olszewski, Menasha, both of Wis.

[73] Assignee: Kimberly-Clark Corporation, Neenah, Wis.

[21] Appl. No.: 896,895

[22] Filed: Aug. 15, 1986

[51] Int. Cl.[4] ..... C11D 17/00

[52] U.S. Cl. ..... 428/288; 252/91; 428/290

[58] Field of Search ..... 428/288, 290; 252/91

[56] References Cited

U.S. PATENT DOCUMENTS

RE 31,885 5/1985 Meitner ..... 252/91

4,448,704 5/1984 Barby et al. ..... 252/91

*Primary Examiner*—Marion C. McCamish

*Attorney, Agent, or Firm*—Gregory E. Croft

[57] ABSTRACT

Polyolefin meltblown sheets suitable as wet wipes, containing from about 100 to about 500 weight percent liquid, exhibit liquid concentration stability over long periods of time. Stacks of these sheets maintain equal liquid concentration from the top to the bottom of the stack notwithstanding evaporation losses through the top of the stack.

5 Claims, 7 Drawing Sheets

Figure 2A Liquid Retention
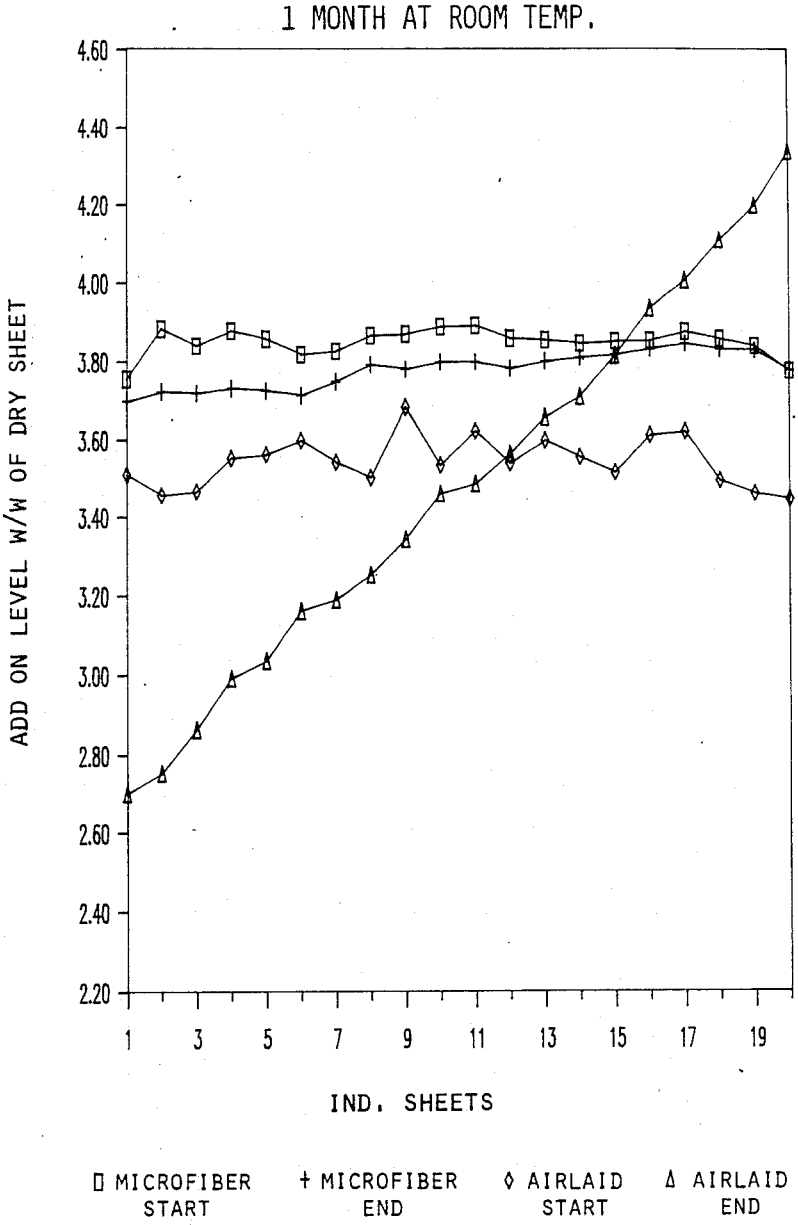

Figure 2B Liquid Retention
1 MONTH AT ROOM TEMP.
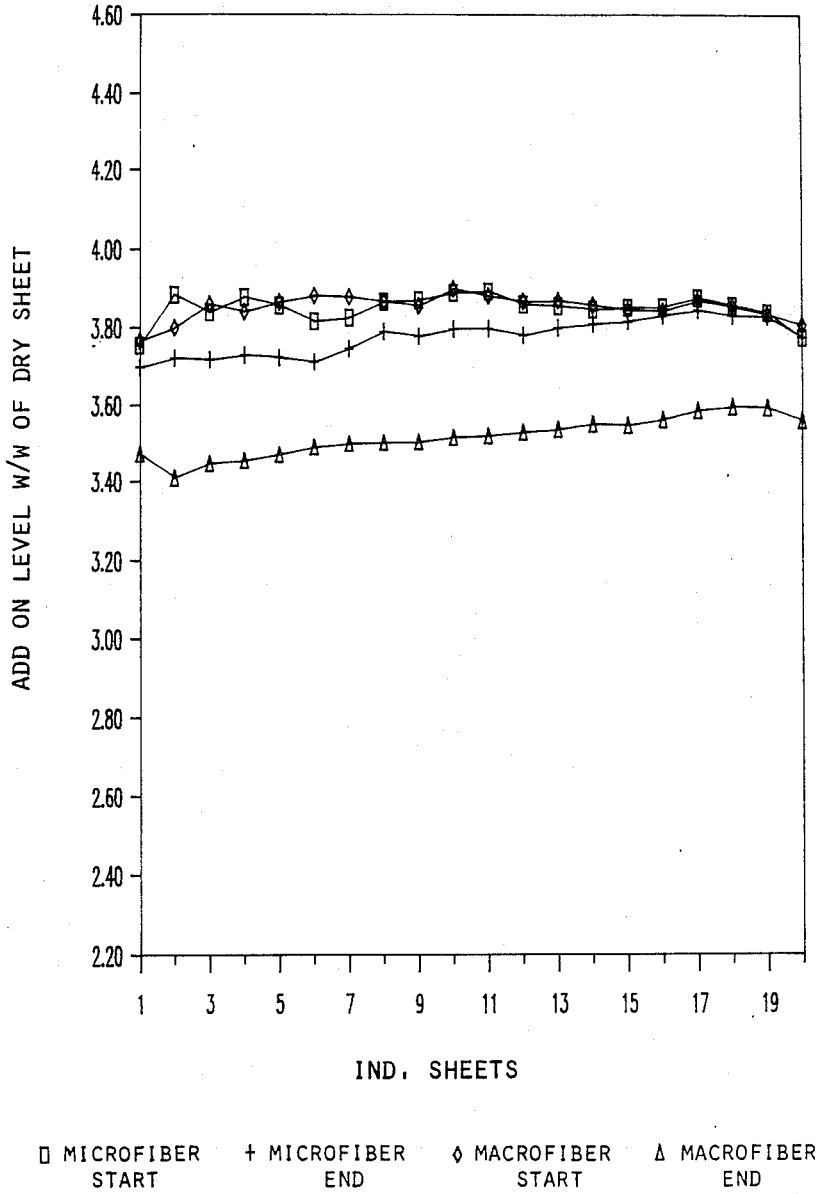

Figure 2C Liquid Retention
1 MONTH AT 40*C
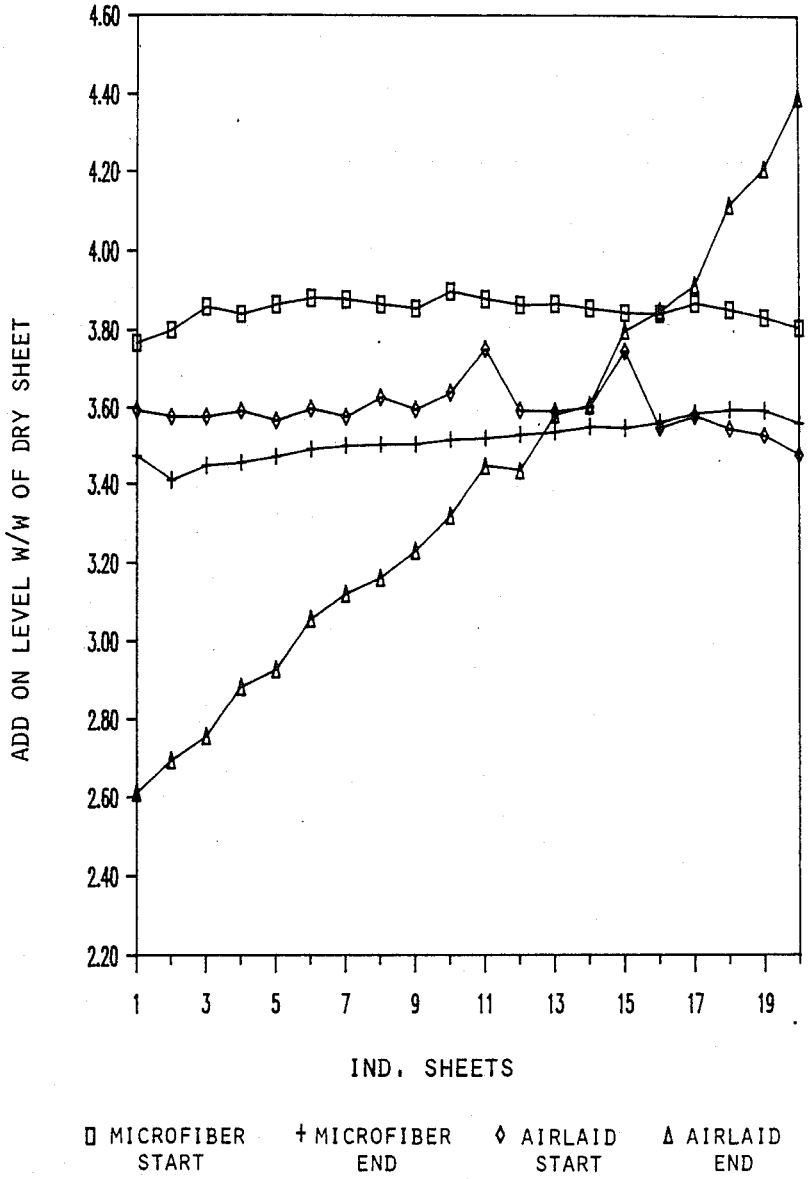

Figure 2D Liquid Retention
1 MONTH AT 40*C
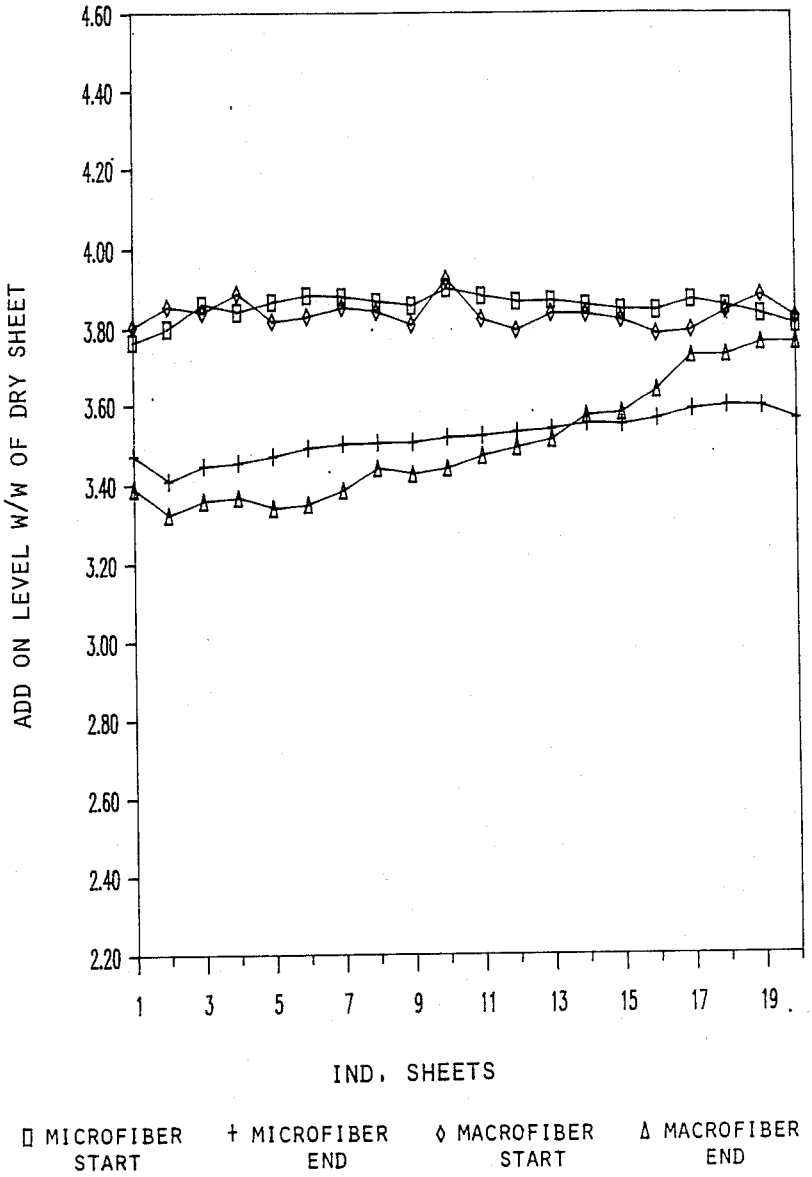
□ MICROFIBER START + MICROFIBER END ◊ MACROFIBER START Δ MACROFIBER END Figure 2E Liquid Retention
1 MONTH AT 50*C
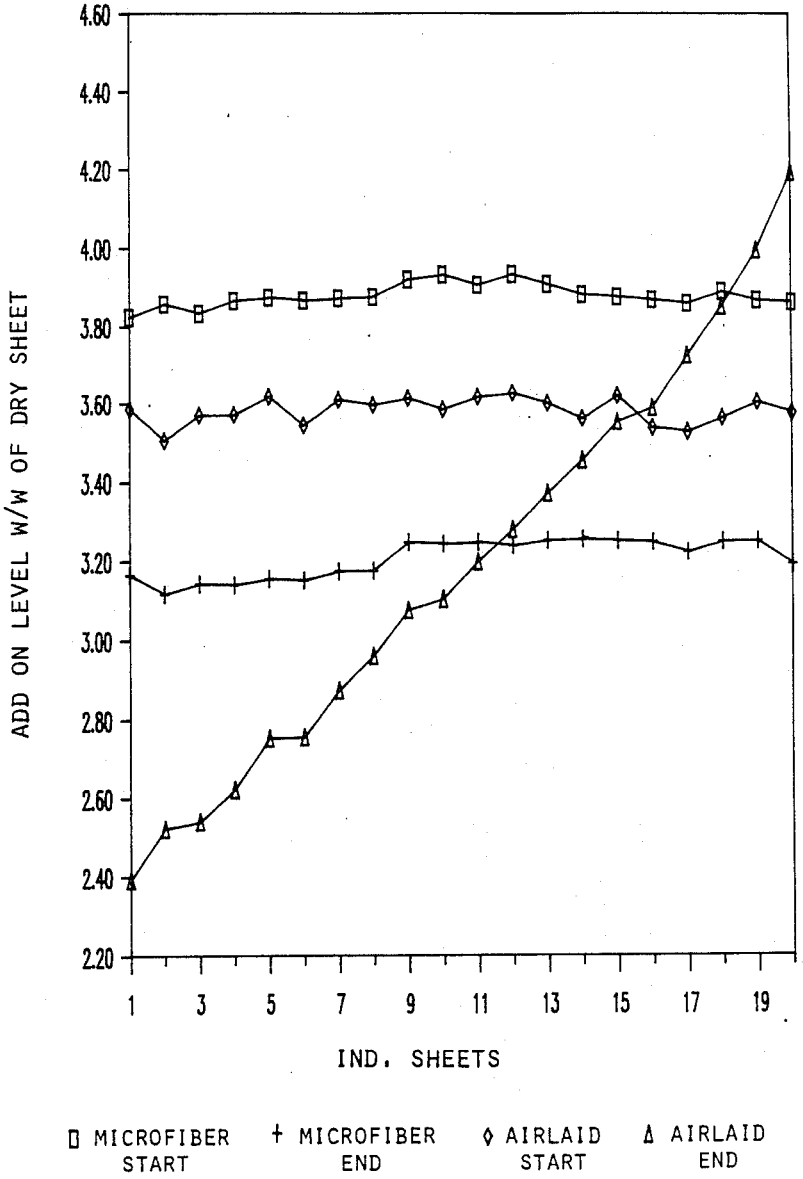

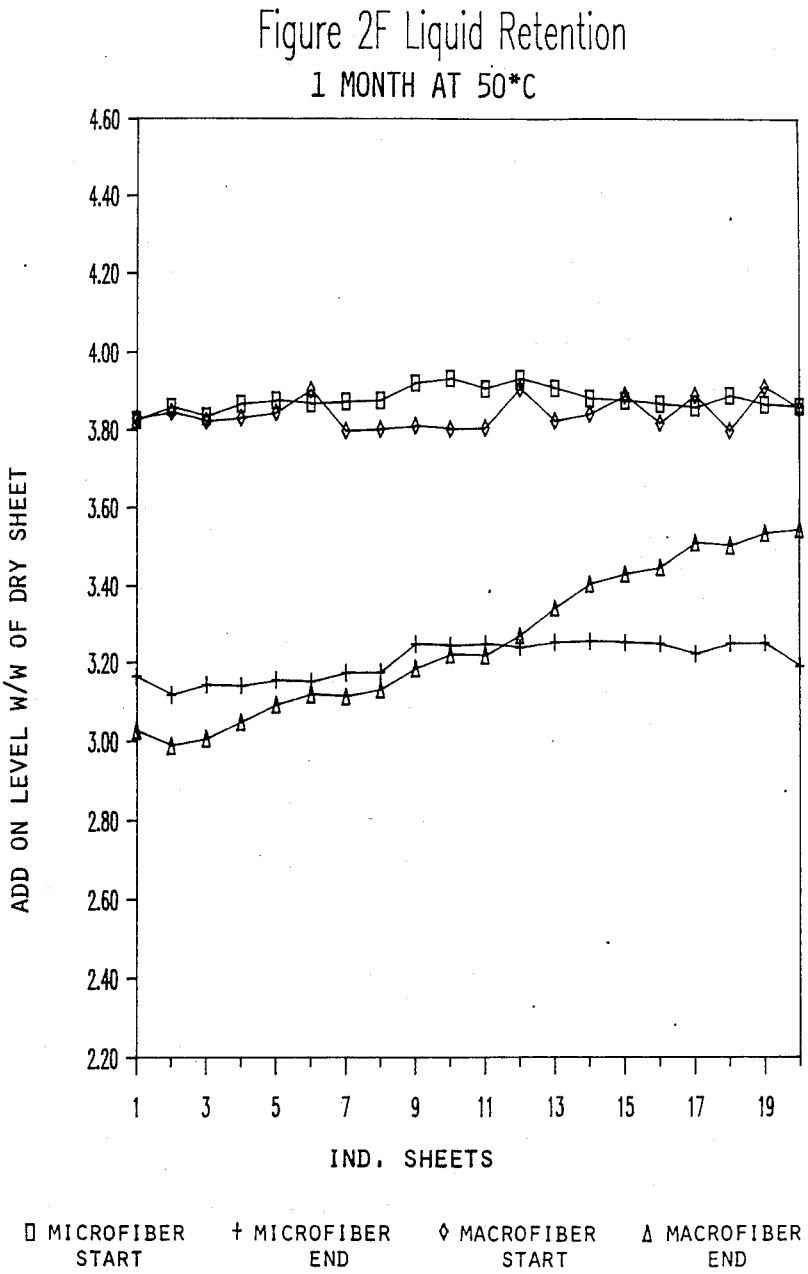
Figure 2F Liquid Retention
1 MONTH AT 50*C
ADD ON LEVEL W/W OF DRY SHEET
4.60
4.40
4.20
4.00
3.80
3.60
3.40
3.20
3.00
2.80
2.60
2.40
2.20
1
3
5
7
9
11
13
15
17
19
IND. SHEETS
MICROFIBER START
MICROFIBER END
MACROFIBER START
MACROFIBER END

UNIFORMLY MOIST WIPES

BACKGROUND OF THE INVENTION

Wet wipes are well known commercial consumer products which are available in many forms. Perhaps the most common form is a stack of individual folded sheets packaged in a plastic container for use as baby wipes. The individual sheets are predominantly made from airlaid cellulosic fibers and are saturated with a suitable wiping solution. Unfortunately, the amount of solution varies from sheet to sheet, gradually increasing from the top of the stack to the bottom, particularly after the container has been opened and the upper sheets have partially dried. In addition, since the solution tends to migrate toward the bottom due to gravity, there often is a pool of liquid in the bottom of the container. This, of course, is wasted solution.

Therefore there is a need for a product that provides a stack of wipes having uniform moisture throughout the stack.

SUMMARY OF THE INVENTION

In one aspect, the invention resides in a stack of moist polyolefin meltblown sheets suitable as wipes, said sheets containing from about 100 to about 500 dry weight percent liquid, wherein each of the sheets within the stack of wipes contains substantially the same concentration of liquid. It has been discovered that wettable polyolefin meltblown webs surprisingly possess the ability to absorb and hold an amount of fluid sufficient for purposes of a moist wipe. When a stack of such wipes is allowed to stand for long periods of time, within a container, the concentration of liquid within each sheet remains substantially equal. If the upper sheets of the stack experience evaporation losses, the lower sheets give up some liquid to equilibrate the liquid concentration throughout the stack. This unique property is very desirable from the user's point of view because the top sheet is never dried out. This property also avoids wasting solution pooled in the bottom of the container.

In another aspect, the invention resides in a moist polyolefin meltblown wipe containing from about 100 to about 500 weight percent liquid.

For purposes herein, the term "stack" is used broadly to include any collection of sheets or webs wherein there is a plurality of surface-to-surface interfaces. This not only includes a vertically stacked collection of individual sheets, but also includes a horizontally stacked collection of sheets and a rolled collection of sheets. In the case of a horizontal stack in accordance with this invention, where the individual sheets are standing on edge, the liquid concentration will be maintained substantially equal from the top to the bottom of each individual sheet, as well as from sheet to sheet. Similarly, with a rolled product form wherein a continuous web of meltblown material is perforated to separate individual sheets and wound into a roll, the concentration of liquid within the roll will equilibrate to substantially equal concentrations, regardless of the orientation of the roll within a dispenser.

Meltblown webs or sheets suitable for the wipes of this invention are well known in the nonwovens industry. Typically such materials are made of polypropylene, although other thermoplastic polyolefins, such as polyethylene, etc. can also be used. Basis weights can be from 15 to about 200 grams per square meter (gsm), with a basis weight of about 40 gsm being preferred. While not wishing to be bound to any theory of operation, it is believed that meltblown polyolefin webs are unique materials which, on the one hand, tightly hold the liquid and, on the other hand, readily transfer the liquid to adjacent contacting meltblown webs through capillary action. At the same time the web will readily express the liquid during use. The method for making meltblown webs is adequately described in U.S. Pat. No. 3,978,185 to Bunting et al. dated Aug. 31, 1976. On a commercial basis, suitable meltblown webs are available from Kimberly-Clark Corporation, Roswell, Ga.

The liquid contained within the wipes of this invention can be any aqueous cleaning solution or germicidal solution which can be absorbed into the wipe. The amount of the liquid within the wipe on a weight percent basis can be from 100 to about 500 percent, suitably from about 150 to about 500 percent, advantageously from about 200 to about 450 percent, preferably from about 360 to about 400 percent, and most preferably about 380 percent. If the amount of liquid is less than the abovesaid range, the wipe will be too dry and will not adequately perform. If the amount of liquid is greater than the abovesaid range, the wipe will be too soggy and the liquid will begin to pool in the container.

BRIEF DESCRIPTION OF THE DRAWING

FIG. 2A is a plot of the liquid concentration of individual sheets within a vertical stack of 20 sheets which has been standing at room temperature for one month, comparing the liquid retention of the microfiber meltblown sheets of the invention with that of the prior art airlaid cellulosic web at the start and the end of the test period.

FIG. 2B is a plot similar to FIG. 2A, comparing the liquid retention of a stack of polypropylene microfiber meltblown sheets and a stack of polypropylene macrofiber meltblown sheets.

FIG. 2C is a plot similar to FIG. 2A, wherein the stacks of microfiber meltblown and airlaid sheets have been standing for one month at 40° C., illustrating the lack of effect of temperature on the ability of the microfiber meltblown sheets of this invention to equilibrate.

FIG. 2D is a plot similar to FIG. 2B, wherein the microfiber meltblown stack and the macrofiber meltblown stack have been standing for one month at 40° C.

FIG. 2E is a plot similar to FIGS. 2A and 2C, wherein the stacks of microfiber meltblown and airlaid sheets have been standing for one month at 50° C.

FIG. 2F is a plot similar to FIGS. 2B and 2D, wherein the stacks of microfiber meltblown and macrofiber meltblown sheets have been standing for one month at 50° C.

DETAILED DESCRIPTION OF THE DRAWING

Figure 1:
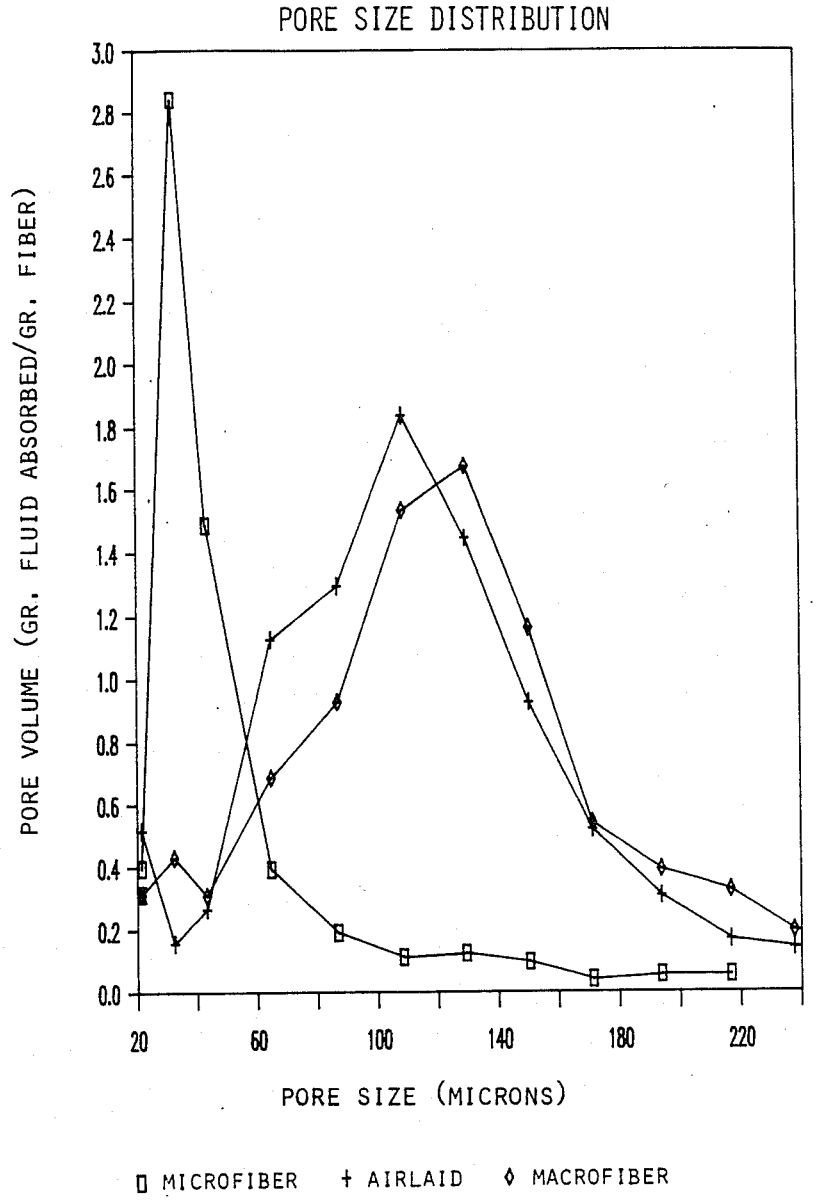
FIG. 1 is a plot of the fluid absorption per gram of fiber vs. the pore size for a polypropylene microfiber meltblown web of this invention, an airlaid web used for prior art wipes, and a polypropylene macrofiber meltblown web formed from fibers having a larger diameter than those used to form the microfiber web, illustrating the pore size distribution of each web. The terms "microfiber" and "macrofiber" are only used herein to distinguish between webs having different pore size distributions.

FIG. 1 illustrates the pore size distribution of the microfiber and macrofiber meltblown web of this invention and that of an airlaid web currently used for commercially available wet wipes. It is believed that the pore size distribution may be a significant factor in the performance of the wipes of this invention. As shown by the plot, the majority of the absorbence of the microfiber meltblown, which is preferred, is due to pores having a size of from about 20 to about 60 microns. (Pore size distribution is determined by the capillary suction method described in copending application Ser. No. 853,494 filed Apr. 18, 1986 in the names of D. D. Endres et al., which is herein incorporated by reference. For the sample microfiber meltblown sheet represented in FIG. 1, the pore volume which is due to pores having a size of from about 20 to about 60 microns is 77%, as calculated by the area under the curve.

FIGS. 2A, 2C, and 2E illustrate the ability of the microfiber meltblown web of this invention to maintain a constant and equal fluid concentration throughout a stack of sheets, in contrast to the liquid pooling tendencies of the airlaid sheets of the prior art. In generating the data for all of the FIG. 2 plots (A–F) 20 wipes were saturated with a cleaning solution at an add-on level of about 380 weight percent liquid based on the dry weight of the sheet. The cleaning solution contained the following ingredients on a weight percent basis: 0.12% Bardac 205M (50% active); 0.005 sodium metasilicate pentahydrate (100% active); 0.03 tetrasodium EDTA (100% active); 0.115 Tergitol 15-S-12 (100% active); 0.18 Fragrance; 99.55 Deionized water. The individual sheet size was 10 inches×13 inches. The individual sheets were quarter-folded and stacked to form a clip of 20 quarter-folded sheets. The clips were double-bagged in sealed plastic bags and allowed to stand for a set period of time at a set temperature. Three clips were tested at each set of conditions. The liquid content of each individual sheet within the clip was measured at the beginning and end of the test. The plots compare the results of this test for the meltblown web of this invention and the airlaid cellulosic web used for current commercially available wet wipes.

In all cases, the microfiber meltblown sheets maintained a substantially constant liquid content from the top sheet of the stack (sheet No. 1) to the bottom of the stack (sheet No. 20) as illustrated by the horizontal plot. On the other hand, the airlaid sheet exhibited an increasing liquid content from the top sheet to the bottom sheet, as illustrated by the positive slope of the airlaid plot.

It is also worthwhile to note that as the temperature of the test increased, the amount of liquid lost to evaporation also increased, as indicated by the vertical distance between the starting concentration plot and the finish concentration plot. Nevertheless, in spite of this liquid loss, all sheets within the microfiber meltblown stack equilibrated to maintain a substantially equal liquid concentration. The macrofiber meltblown stack appeared to show some temperature effect as shown in FIG. 2F, but nevertheless is greatly improved relative to the airlaid sheets at the same conditions.

It will be appreciated that the foregoing examples, shown for purposes of illustration, are not to be construed as limiting the scope of the invention.

We claim:

1. A stack of moist wipes within a container, said stack comprising a plurality of polyolefin microfiber meltblown sheets containing from about 100 to about 500 dry weight percent liquid, wherein each of the sheets within the stack of wipes contains substantially the same concentration of liquid and can maintain a substantially equal concentration of liquid for at least 30 days.

2. The stack of moist wipes of claim 1 wherein the amount of liquid in each sheet within the stack is from about 200 to about 450 dry weight percent.

3. The stack of wipes of claim 2 wherein the sheets within the stack are polypropylene sheets having a basis weight of from about 15 to about 200 grams per square meter.

4. The stack of wipes of claim 1 wherein at least about 65 percent of the pore volume of the sheets within the stack is attributable to pores having a size of from about 20 to about 60 microns.

5. A stack of moist wipes within a container, said stack comprising about 20 polypropylene microfiber meltblown sheets containing from about 200 to about 450 dry weight percent liquid, wherein each of the sheets within the stack of wipes contains substantially the same concentratin of liquid and can maintain a substantially equal concentration of liquid for at least 30 days.

* * * * *